US012559915B2

(12) United States Patent
Yoshida et al.

(10) Patent No.: US 12,559,915 B2
(45) Date of Patent: Feb. 24, 2026

(54) WORK CONTROL METHOD, WORK CONTROL SYSTEM, AND TARGET POINT SETTING APPARATUS

(71) Applicant: NEC Corporation, Tokyo (JP)

(72) Inventors: Hiroshi Yoshida, Tokyo (JP); Tatsuya Yoshimoto, Tokyo (JP)

(73) Assignee: NEC CORPORATION, Tokyo (JP)

( * ) Notice: Subject to any disclaimer, the term of this patent is extended or adjusted under 35 U.S.C. 154(b) by 391 days.

(21) Appl. No.: 18/021,773

(22) PCT Filed: Jul. 16, 2021

(86) PCT No.: PCT/JP2021/026837

§ 371 (c)(1),
(2) Date: Sep. 28, 2023

(87) PCT Pub. No.: WO2022/070560

PCT Pub. Date: Apr. 7, 2022

(65) Prior Publication Data

US 2024/0052603 A1 Feb. 15, 2024

(30) Foreign Application Priority Data

Sep. 29, 2020 (JP) ..... 2020-162901

(51) Int. Cl.
*E02F 9/00* (2006.01)
*E02F 9/20* (2006.01)
*E02F 9/26* (2006.01)

(52) U.S. Cl.
CPC ..... *E02F 9/262* (2013.01); *E02F 9/205* (2013.01)

(58) Field of Classification Search
CPC ..... E02F 9/262; E02F 9/205; E02F 9/2045; E02F 9/20; E02F 9/00
(Continued)

(56) References Cited

U.S. PATENT DOCUMENTS

2020/0131740 A1* 4/2020 Hashimoto ..... E02F 9/262
2021/0246627 A1* 8/2021 Konda ..... E02F 3/651
2023/0243127 A1* 8/2023 Okuwaki ..... E02F 3/32 701/34.2

FOREIGN PATENT DOCUMENTS

JP H07-64622 A 3/1995
JP 2015-068019 A 4/2015
(Continued)

OTHER PUBLICATIONS

International Search Report for PCT Application No. PCT/JP2021/026837, mailed on Oct. 12, 2021.
(Continued)

*Primary Examiner* — Shardul D Patel
(74) *Attorney, Agent, or Firm* — Sughrue Mion, PLLC

(57) ABSTRACT

In a related technique, a target point sequence is generated without considering the content of a work of a construction machine, which causes a problem that an actual trajectory of the construction machine is significantly deviated from the target point sequence depending on the content of the work of the construction machine. A work control method according to the present invention includes: a target point setting step of generating, based on work content information, a work target point sequence indicating a target trajectory on which target points a construction machine is to move to are plotted, and a construction machine control step of controlling the construction machine in accordance with the work target point sequence.

14 Claims, 8 Drawing Sheets

(58) Field of Classification Search
USPC ..... 701/50
See application file for complete search history.

(56) References Cited

FOREIGN PATENT DOCUMENTS

| | | | |
|---|---|---|---|
| JP | 2020-125669 | A | 8/2020 |
| JP | 2022-034650 | A | 3/2022 |

OTHER PUBLICATIONS

JP Office Communication for JP Application No. 2022-553490, mailed on Apr. 30, 2024 with English Translation.

* cited by examiner

WORK CONTROL METHOD, WORK CONTROL SYSTEM, AND TARGET POINT SETTING APPARATUS

This application is a National Stage Entry of PCT/JP2021/026837 filed on Jul. 16, 2021, which claims priority from Japanese Patent Application 2020-162901 filed on Sep. 29, 2020, the contents of all of which are incorporated herein by reference, in their entirety.

TECHNICAL FIELD

The present invention relates to a work control method, a work control system, and a target point setting apparatus, and in particular, to a work control method, a work control system, and a work control apparatus for setting an operation trajectory of a construction machine to cause the construction machine to operate along this trajectory.

BACKGROUND ART

In a robot including a construction machine, target points are set on a target trajectory and these target points are traced, thereby operating a control target position along the target trajectory. In this case, in terms of improving a work efficiency, it is required to move the control target position as soon as possible while suppressing a deviation from this trajectory. Patent Literature 1 and 2 disclose examples of a method for computing target points provided on a target trajectory set in robot control.

A robot trajectory complement apparatus disclosed in Patent Literature 1 is a trajectory interpolation apparatus that generates a target trajectory from teaching points input in advance in a robot control apparatus, the robot trajectory complement apparatus including: interpolation method selection means for selecting, when a target path having a polygonal line shape defined by connecting three or more consecutive teaching points by straight lines has been provided, a method for performing an interpolation between teaching points by a moving instruction and the value of an allowable path error added to a node of the polygonal line at the time of teaching, circular interpolation computation means for performing, when the moving instruction is circular interpolation, interpolation among three points that form the polygonal line by a circular arc, linear interpolation computation means for generating, when the allowable path error is 0, a target trajectory by a linear trajectory with the node as an endpoint, clothoid curve interpolation computation means for generating, when the allowable path error is not 0, a curve trajectory that is smoothly connected to two straight lines that form the polygonal line by a clothoid curve in which the allowable error value is a parameter, and joint angle computation means for receiving a trajectory output from one of the three interpolation computation means and outputting an amount of movement of a joint angle per unit interpolation time.

A trajectory calculation system disclosed in Patent Literature 2 includes a calculation device that performs a process of generating a trajectory on which a conveyance object is conveyed on a trajectory including an arcuate trajectory by conveying equipment with a suspension posture between waypoints inside a building. The calculation device includes a posture calculation unit that calculates a candidate of the suspension posture of the conveyance object inside the building by using building data, conveyance object data, kinematic parameter of the conveying equipment, waypoint information and others, a trajectory calculation unit that calculates a candidate of the trajectory including the arcuate trajectory, an interference computation unit that determines presence or absence of interference between the building and the conveyance object in the suspension posture on the trajectory of the candidate, and a path calculation unit that determines a trajectory including the suspension posture and the arcuate trajectory without interference.

CITATION LIST

Patent Literature

[Patent Literature 1] Japanese Unexamined Patent Application Publication No. H07-064622

[Patent Literature 2] Japanese Unexamined Patent Application Publication No. 2015-068019

SUMMARY OF INVENTION

Technical Problem

In Patent Literature 1 and 2, the content of the work is not taken into account when target points are determined, which causes a problem that it is not always possible to improve the work efficiency under conditions in which the positional accuracy of a control target position that is required or a load applied to the work target position greatly varies depending on a work.

Solution to Problem

One aspect of a work control method according to the present invention includes:

a target point setting step of generating, based on work content information, a work target point sequence indicating a target trajectory on which target points a construction machine is to move to are plotted; and a construction machine control step of controlling the construction machine in accordance with the work target point sequence.

One aspect of a work control system according to the present invention includes: a target point setting unit configured to generate, based on work content information, a work target point sequence indicating a target trajectory on which target points a construction machine is to move to are plotted; and a construction machine control unit configured to control the construction machine in accordance with the work target point sequence.

One aspect of a target point setting apparatus according to the present invention includes: an initial target point sequence generation unit configured to generate an initial target point sequence where target points are plotted at predetermined initial intervals on a target trajectory whose shape is determined based on work content information; and a target point deletion processing unit configured to generate a work target point sequence in which unevenness of the density of the target points is provided for each unit section by reducing the number of target points included in the initial target point sequence in accordance with the work content information, and thus outputting the work target point sequence to a construction machine control unit that controls the construction machine.

Advantageous Effects of Invention

According to a work control method, a work control system, and a target point setting apparatus of the present invention, it is possible to perform control with a high accuracy and a high efficiency in which the content of a work is taken into account.

EXAMPLE EMBODIMENT

Figure 1:
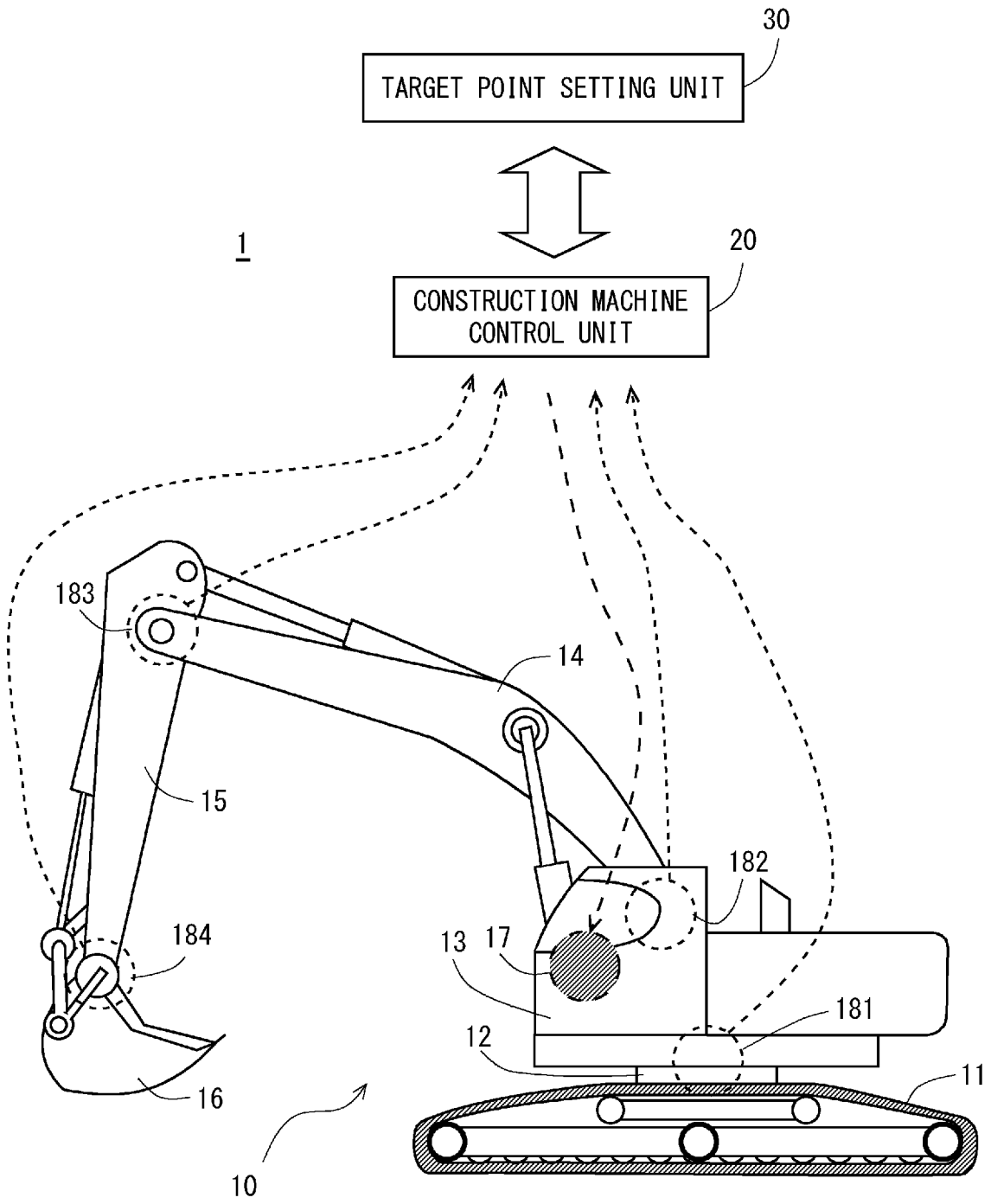
FIG. 1 is a schematic diagram of a work control system according to a first example embodiment.

For clarity of explanation, the following descriptions and drawings will be appropriately omitted and simplified. Further, the respective components described in the drawings as functional blocks which perform various kinds of processing can be configured by Central Processing Units (CPUs), memories or other circuits in terms of hardware, and are achieved by programs loaded in memories, or the like in terms of software. Accordingly, it will be understood by those skilled in the art that these functional blocks can be implemented in various forms by only hardware, only software or a combination thereof. They are not limited to any of them. Incidentally, in the respective drawings, the same components are denoted by the same reference numerals, and dual description will be omitted as needed.

Further, the above-described program can be stored and provided to a computer using any type of non-transitory computer readable media. Non-transitory computer readable media include any type of tangible storage media. Examples of non-transitory computer readable media include magnetic storage media (such as flexible disks, magnetic tapes, hard disk drives, etc.), optical magnetic storage media (e.g., magneto-optical disks), CD-Read Only Memory (CD-ROM), CD-R, CD-R/W, and semiconductor memories (such as mask ROM, Programmable ROM (PROM), Erasable PROM (EPROM), flash ROM, Random Access Memory (RAM), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g., electric wires, and optical fibers) or a wireless communication line.

FIRST EXAMPLE EMBODIMENT

Hereinafter, with reference to the drawings, an example embodiment of the present invention will be described. A work control method, a work control system, and a target point setting apparatus of a construction machine described below control a construction machine that drives movable parts by a hydraulic pressure, a motor or the like. The following description will be made taking a backhoe as an example of the construction machine. Further, while a work control system in which process blocks that perform work control processing are arranged in a plurality of places in a distributed manner via a network will be described in the following description, a work control apparatus in which the process blocks included in the work control system are formed of one apparatus may be employed. For example, a target point setting unit 30 and a construction machine control unit 20 that will be described later may be one apparatus. Further, the content of the control performed in the work control system will be referred to as a work control method. Specific examples thereof will be described later in detail. Further, in the following description, a target point setting unit provided in a work control system will be described as an example of the target point setting apparatus.

Further, the work control system that will be described below may be applied to a machine having a manipulation lever that can be operated by a worker as a construction machine or may be applied to a machine that directly controls an actuator or the like by an electrical signal without using a manipulation lever. Hereinafter, as an example, an example in which a construction machine including a manipulation lever is controlled by a work control apparatus will be described.

FIG. 1 shows a schematic diagram of a work control system 1 according to the first example embodiment. A construction machine 10 shown in FIG. 1 is a backhoe. The construction machine 10 includes a crawler 11, a turning base 12, a cockpit 13, a boom 14, an arm 15, and a bucket 16. The crawler 11 is a caterpillar for moving the construction machine 10. The turning base 12 turns a chassis on which the cockpit 13, the boom 14 and the like are mounted. The cockpit 13 is a manipulation room in which a manipulation lever and the like for manipulating the posture of the construction machine 10 are disposed. Further, while the drawings are in a simplified form, in the work control system 1, a construction machine drive processing unit 17 is disposed in the construction machine 10. Further, each of the boom 14, the arm 15, and the bucket 16 corresponds to a movable part and is operated by a hydraulic cylinder. This hydraulic cylinder is elongated or contracted by an action of the construction machine drive processing unit 17. While the part that corresponds to the movable part includes, for example, besides the hydraulic cylinder, a part that is driven by the motor, a hydraulic cylinder will be described as an example of the movable part.

Further, in the work control system 1 according to the first example embodiment, posture sensors 181-184 for detecting posture angles are attached to the movable parts of the construction machine 10. In the example shown in FIG. 1, the posture sensor 181 detects the rotation angle of the turning base 12, the posture sensor 182 detects the current angle of the boom 14, the posture sensor 183 detects the relative angle of the boom 14 and the arm 15, and the posture sensor 184 detects the relative angle of the arm 15 and the bucket 16.

In the work control system 1 according to the first example embodiment, a construction machine control unit 20 and a target point setting unit 30 that correspond to the construction machine 10 are provided. The construction machine control unit 20 provides an input value, which is a specific operation instruction, for the construction machine drive processing unit 17. The construction machine control unit 20 further generates a posture detection value based on the information on the angles acquired from the posture sensors 181-184. Further, the target point setting unit 30 generates a work target point sequence indicating a target trajectory in which target points to which the construction machine 10 will move are plotted based on the work control information indicating the content of the work to be performed by the construction machine 10. The construction machine control unit 20 then performs feedback control in such a way that the difference between the posture detection value and the target angle of each drive part generated based on the work target point sequence provided from the target point setting unit 30 is minimized to generate an input value to be provided for the construction machine drive processing unit 17.

Figure 2:
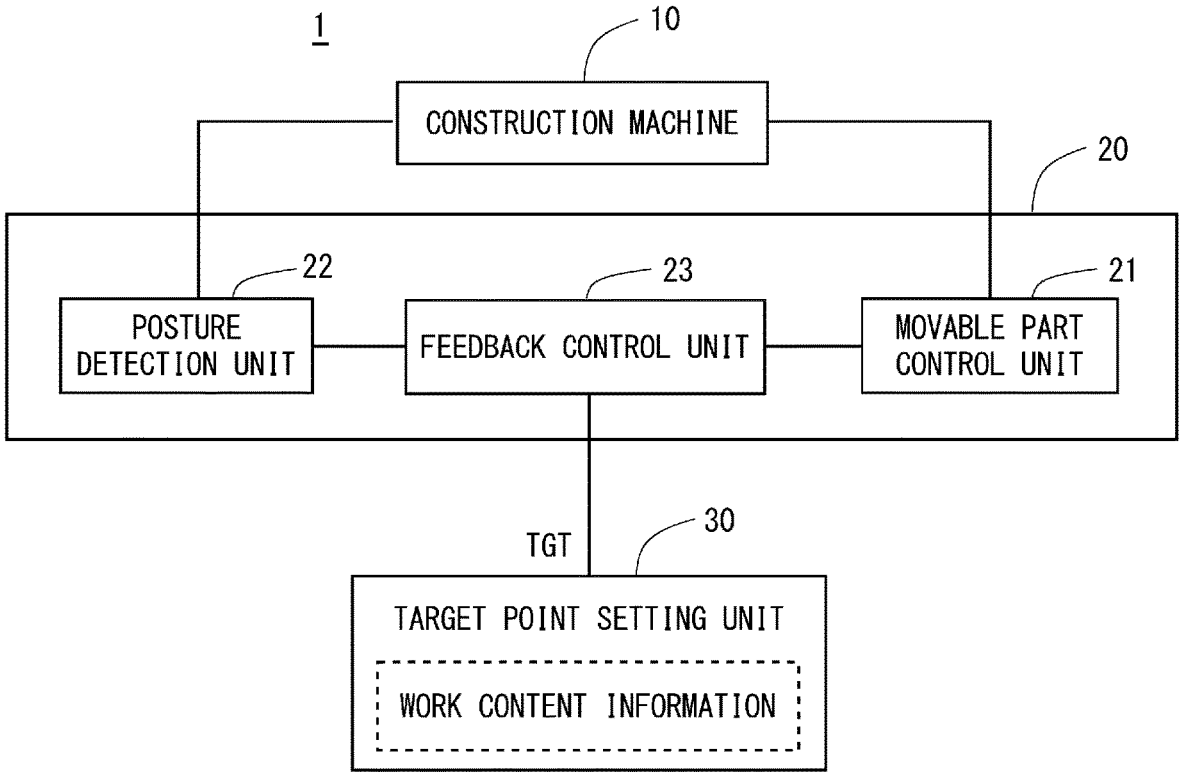
FIG. 2 is a block diagram of the work control system according to the first example embodiment.

Next, a configuration of the process block of the work control system 1 according to the first example embodiment will be described. FIG. 2 shows a block diagram of the work control system according to the first example embodiment. The construction machine 10 is shown in FIG. 2 as a target to be controlled by the work control system 1. In the example shown in FIG. 2, the work control system 1 includes the construction machine control unit 20 and the target point setting unit 30.

The construction machine control unit 20 executes a construction machine control step of controlling the construction machine 10 in accordance with a work target point sequence TGT generated by the target point setting unit 30. The target point setting unit 30 executes a target point setting step of generating a work target point sequence indicating a target trajectory in which target points to which the construction machine will move are plotted based on the work content information. Further, the target point setting unit 30 sets, in this target point setting step, the unevenness of the target points included in the work target point sequence for each unit section in accordance with the content of the work performed by the construction machine 10, and the conditions of the work including at least one index of the positional accuracy importance in the content of the work of the construction machine.

The construction machine control unit 20 includes a movable part control unit 21, a posture detection unit 22, and a feedback control unit 23. The movable part control unit 21 provides a specific operation instruction for the construction machine drive processing unit 17 of the construction machine 10 based on the input value that the feedback control unit 23 generates based on the difference between the work target point sequence TGT and the postured detection value output from the posture detection unit 22. The posture detection unit 22 generates a posture detection value from the values obtained from the posture sensors 181-184. The feedback control unit 23 performs feedback control in such a way that the angle value of each movable part indicated by the posture detection value approaches the target angle value computed from the target point included in the work target point sequence, thereby generating the input value to be provided for the movable part control unit 21.

As described above, in the work control system 1 according to the first example embodiment, the construction machine control unit 20 controls the construction machine 10 in accordance with the work target point sequence TGT generated by the target point setting unit 30. One of the features of the work control system 1 according to the first example embodiment is that the target point setting unit 30 generates the work target point sequence TGT generated in accordance with the content of the work to be performed by the construction machine 10. More specifically, in the target point setting unit 30 according to the first example embodiment, the generated work target point sequence has unevenness of target points in accordance with the content of the work for each unit section. In the following, the target point setting unit 30 will be described in further detail.

Figure 3:
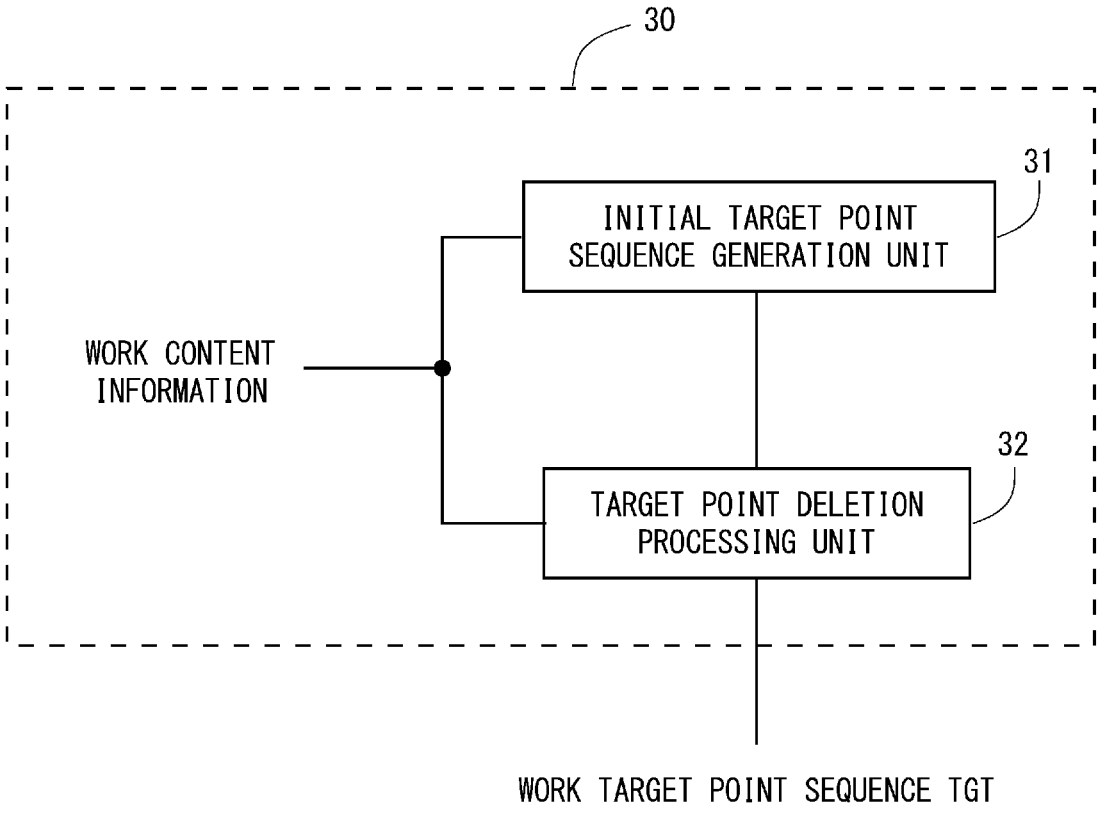
FIG. 3 is a block diagram showing a target point setting unit according to the first example embodiment.

FIG. 3 shows a block diagram of the target point setting unit 30 according to the first example embodiment. As shown in FIG. 3, the target point setting unit 30 includes an initial target point sequence generation unit 31 and a target point deletion processing unit 32. The initial target point sequence generation unit 31 and the target point deletion processing unit 32 are provided with work content information. This work content information includes information indicating the conditions of the work to be performed by the construction machine 10. The conditions of the work include, for example, the position of the bucket of the start point and the end point of a moving trajectory of the bucket, which is a control target position. Further, the conditions of the work include, for example, the type of the work such as an excavation work, a levelling work, a work of loading a dump truck with earth and sand, and information on the specification or the like of the accuracy of the position of the bucket that varies for each type of the work. This work content information may be directly input by the operator, may be generated by a computer in accordance with the position of the work and the type of the work specified by the operator depending on, for example, situations at a work site, or may be totally generated by automatic processing by a computer.

The initial target point sequence generation unit 31 executes an initial target point sequence generation step of generating an initial target point sequence in which the intervals of the target points are plotted at predetermined initial intervals and the target points are plotted on the target trajectory. In another aspect, the initial target point sequence generation unit 31 generates an initial target point sequence in which target points are plotted at predetermined initial intervals on the target trajectory whose shape is determined based on the work content information. The initial intervals are, for example, intervals of the target points sufficiently shorter than the maximum distance where the construction machine 10 can move in a control period time of the construction machine 10 in the work control system 1.

The target point deletion processing unit 32 executes a target point deletion step of providing unevenness in the density of target points included in the work target point sequence TGT for each unit section by reducing the number of target points included in the initial target point sequence in accordance with the work content information. While the details will be described later, the target point deletion processing unit 32 executes, as processing for deleting the target points in accordance with the work content information, at least one of a first target point determination step (e.g., operation content dependent target point determination step) and a second target point determination step (e.g., position accuracy dependent target point determination step). Further, the target point deletion processing unit 32 performs a third target point determination step (e.g., curvature dependent target point determination step) as processing for optimizing the target point in accordance with the shape of the target trajectory. In the operation content dependent target point determination step, the position accuracy dependent target point determination step, and the curvature dependent target point determination step, target points to be excluded from the target of thinning in the following target point thinning step are set.

Figure 4:
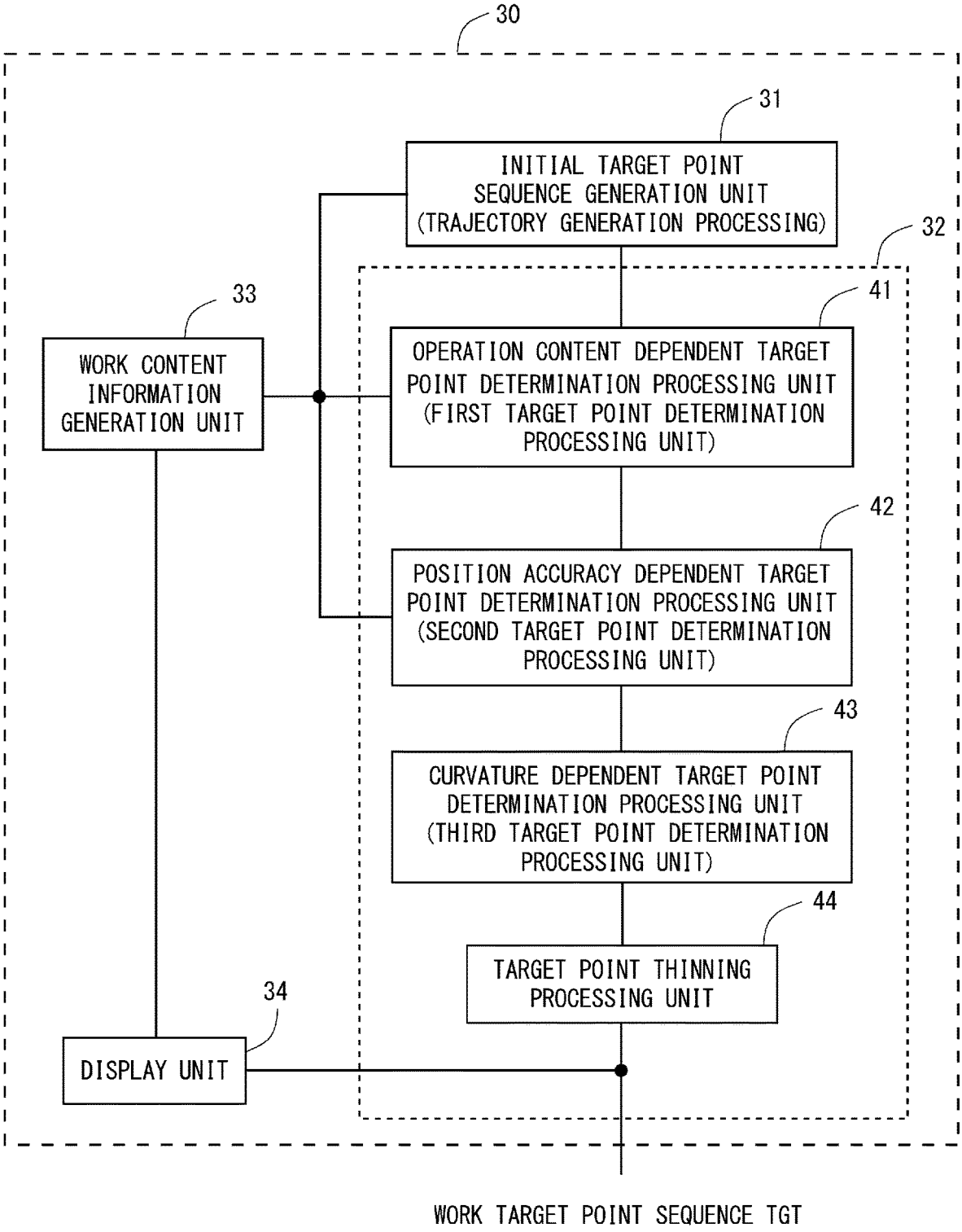
FIG. 4 is a detailed block diagram of the target point setting unit according to the first example embodiment.

The target point setting unit 30 will be described in further detail. FIG. 4 shows a detailed block diagram of the target point setting unit 30 according to the first example embodiment. In the block diagram shown in FIG. 4, a work content information generation unit 33 and a display unit 34 are added to the components in the block diagram shown in FIG. 3. Further, the block diagram in FIG. 4 shows a detailed process block in the target point deletion processing unit 32. More specifically, as process blocks in the target point deletion processing unit 32, a first target point determination processing unit (e.g., operation content dependent target point determination processing unit 41), a second target point determination processing unit (e.g., position accuracy dependent target point determination processing unit 42), a third target point determination processing unit (e.g., curvature dependent target point determination processing unit 43), and a target point thinning processing unit 44 are shown.

The work content information generation unit 33 generates work content information upon receiving an instruction from an operator or by automatic processing. The work content information generated by the work content information generation unit 33 is provided for the initial target point sequence generation unit 31 and the target point deletion processing unit 32. The process blocks in which the work content information is input in the target point deletion processing unit 32 are the operation content dependent target point determination processing unit 41 and the position accuracy dependent target point determination processing unit 42. The display unit 34 is disposed to provide an interface for enabling an operator to operate the target point setting unit 30 or to check the content of the operation. The display unit 34 may be, for example, a touch panel or the like into which the operator enters the conditions of the work or may be a display or the like that presents the shape of the work target point sequence TGT generated by the target point deletion processing unit 32 for the worker.

Now, the initial target point sequence generation unit 31 will be described in detail. The initial target point sequence generation unit 31 executes an initial target point sequence generation step of generating an initial target point sequence in which intervals of the target points are plotted at predetermined initial intervals and the trajectory has a shape in accordance with the work content information. When the target trajectory is generated, simply connecting the start point and the end point of the target trajectory with a straight line may cause a situation in which obstacles between them cannot be avoided. In order to solve this problem, in the initial target point sequence generation step, a curve may be provided in the trajectory between the start point and the end point of the target trajectory indicated by the work content information. In this case, the initial target point sequence generation unit 31 determines the shape of the target trajectory by setting the shape of the curve using a power function. This power function will be described.

The power function can be expressed, for example, by Expression (1). This Expression (1) expresses the y coordinate of the trajectory when the y coordinate of the start point is denoted by y1, the x coordinate of the start point is denoted by x1, the y coordinate of the end point is denoted by y2, the x coordinate of the end point is denoted by x2, and the x coordinate between the start point and the end point is denoted by x. Further, p in Expression (1) denotes a power. By changing the value of this p, the curvature of the target trajectory is changed.

[Expression 1]

$$y = (y1 - y2)\left\{\frac{(x - x1)}{(x2 - x1)}\right\}^{p} + y1 \tag{1}$$

Figure 5:
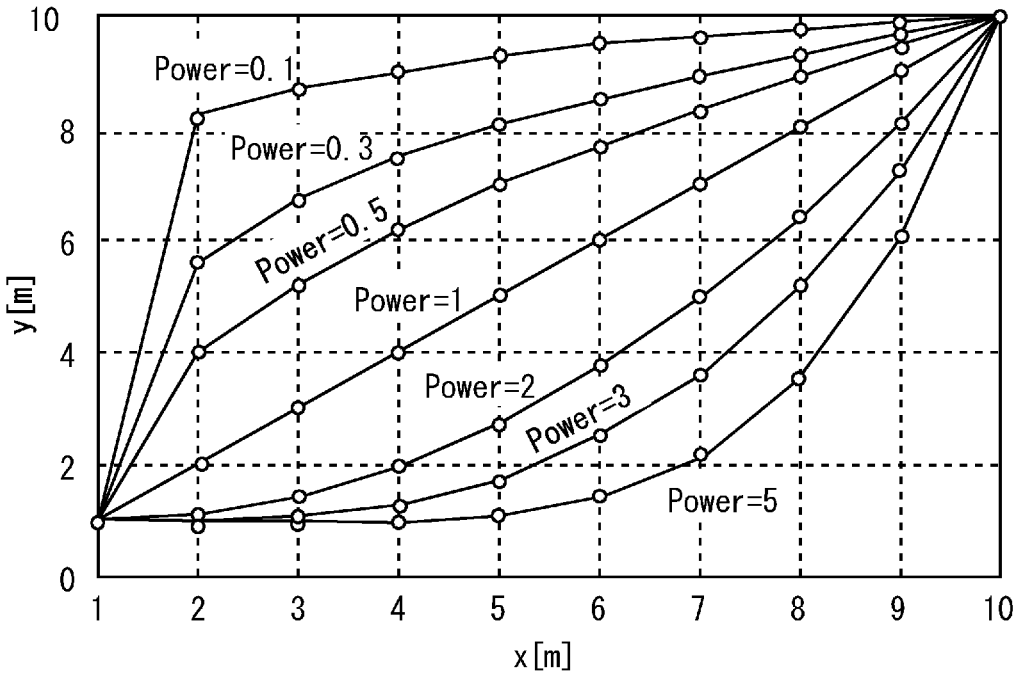
FIG. 5 is a graph for describing a power function that is used to set a curved part in an initial target point sequence according to the first example embodiment.

Now, FIG. 5 shows a graph showing a power function used when a curved part is set in the initial target point sequence according to the first example embodiment. The example shown in FIG. 5 is an example of the trajectory derived from this Expression (1). It can be seen from FIG. 5 that the shape of the trajectory between the start point (e.g., the point where the x coordinate is 0 and the y coordinate is 1) and the end point (e.g., the point where the x coordinate is 10 and the y coordinate is 10) is changing by changing the power value p.

Further, as shown in FIG. 4, the target point deletion processing unit 32 includes the operation content dependent target point determination processing unit 41, the position accuracy dependent target point determination processing unit 42, the curvature dependent target point determination processing unit 43, and the target point thinning processing unit 44.

The operation content dependent target point determination processing unit 41 executes a first target point determination step (e.g., work content dependent target point determination step) of setting more target points to be left as target points included in the work target point sequence TGT than those left in other sections as the degree of need to make the actual trajectory along which the construction machine actually moves match the target trajectory becomes higher. The degree of need to make the actual trajectory of the construction machine 10 match the target trajectory is indicated by the work content information. The target point deletion processing unit 32 then refers to the work content information and increases, for a section where the degree of need to make the actual trajectory of the construction machine 10 match the target trajectory is high, the number of target points included in the work target point sequence whose target points will not be deleted in the following processing by the target point thinning processing unit 44. In this way, the work where the degree of need to make the actual trajectory of the construction machine 10 match the target trajectory is high may include, for example, a levelling work or a work of loading a dump truck with earth and sand. On the other hand, the work where the degree of need to make the actual trajectory match the target trajectory is low may include, for example, a work for lifting the bucket. The above setting is done because the range of an action varies depending on the trajectory in the levelling work or the work of loading a dump truck with earth and sand, whereas the trajectory is not significantly affected in the operation of lifting the bucket.

The position accuracy dependent target point determination processing unit 42 executes a second target point determination step (e.g., position accuracy dependent target point determination step) of leaving more target points which are in the vicinity of a position specified as requiring high positional accuracy by the work content information than those left in the other sections as target points included in the work target point sequence TGT. This type of work having high positional accuracy importance may include, for example, positioning of an excavation work, or a work of loading a dump truck with earth and sand.

The curvature dependent target point determination processing unit 43 executes a third target point determination step (e.g., curvature dependent target point determination step) of setting, for a part where the curvature of the target trajectory is large, more target points to be left as target points included in the work target point sequence TGT than those left in the other sections. When the curvature becomes large, the deviation between the target trajectory and the actual trajectory increases unless the target points are set with short intervals between them and the construction machine 10 is slowly operated. Therefore, the larger the curvature is, the larger the number of target points included in the work target point sequence TGT, whereby it is possible to perform control with a high accuracy. On the other hand, when the curvature is small (when the target trajectory is close to a straight line), the deviation between them is small even when the number of target points is small. Therefore, the smaller the curvature is, the smaller the number of target points included in the work target point sequence may be (the target point sequence may be sparse), whereby it is possible to perform control without decreasing its accuracy.

The target point thinning processing unit 44 executes, when a distance between target points included in the initial target point sequence becomes equal to or larger than a threshold, a target point thinning step of thinning target points shorter than the threshold. Further, the target point thinning processing unit 44 excludes target points specified to be left in the operation content dependent target point determination processing unit 41, the position accuracy dependent target point determination processing unit 42, and the curvature dependent target point determination processing unit 43 from the target to be thinned. For example, in the work control system 1, by reducing the number of target points in a section of a linearly moving trajectory or target points in a traveling section where there is no problem even when there is a slight deviation, the operation speed of the construction machine 10 is increased and the work efficiency is improved.

Figure 6:
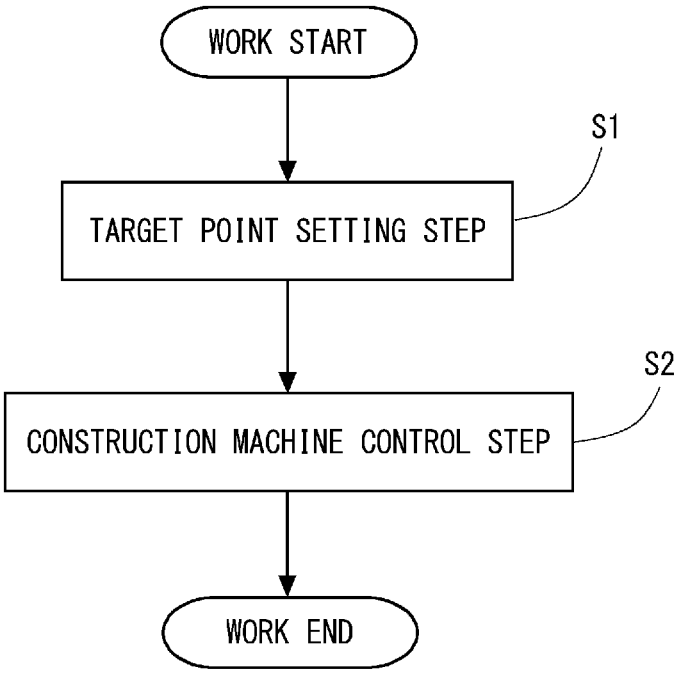
FIG. 6 is a flowchart for describing an operation of the work control system according to the first example embodiment.

Next, an operation of the work control system 1 according to the first example embodiment will be described. FIG. 6 shows a flowchart for describing the operation of the work control system 1 according to the first example embodiment. As shown in FIG. 6, in the work control system 1 according to the first example embodiment, after the operation is started, the target point setting step is first executed (Step S1). In this Step S1, the work target point sequence TGT is generated by the target point setting unit 30. Then, after Step S1 is ended, the construction machine control unit 20 executes a construction machine control step in accordance with the work target point sequence TGT (Step S2). Then, the control of the construction machine control step in Step S2 in accordance with the work target point sequence TGT continues until the work is ended.

Figure 7:
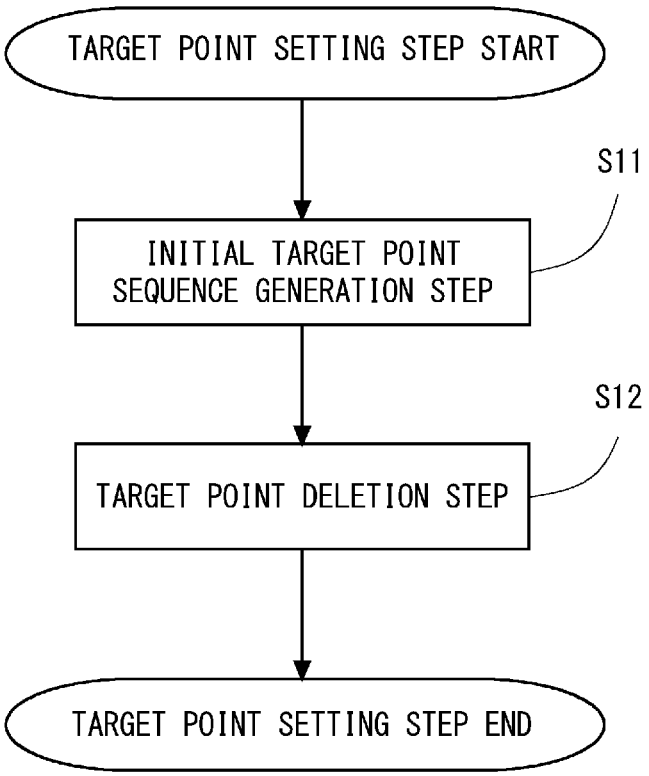
FIG. 7 is a flowchart for describing an operation of the target point setting unit according to the first example embodiment.

One of the features of the work control system 1 according to the first example embodiment is the target point setting step in Step S1. FIG. 7 shows a flowchart for describing an operation of the target point setting unit 30 according to the first example embodiment.

As shown in FIG. 7, in the target point setting step, first, the initial target point sequence generation unit 31 performs an initial target point sequence generation step of generating the above-described initial target point sequence TGT (Step S11). Next, in the target point setting step, the target point deletion processing unit 32 executes the above-described target point deletion step (Step S12).

Figure 8:
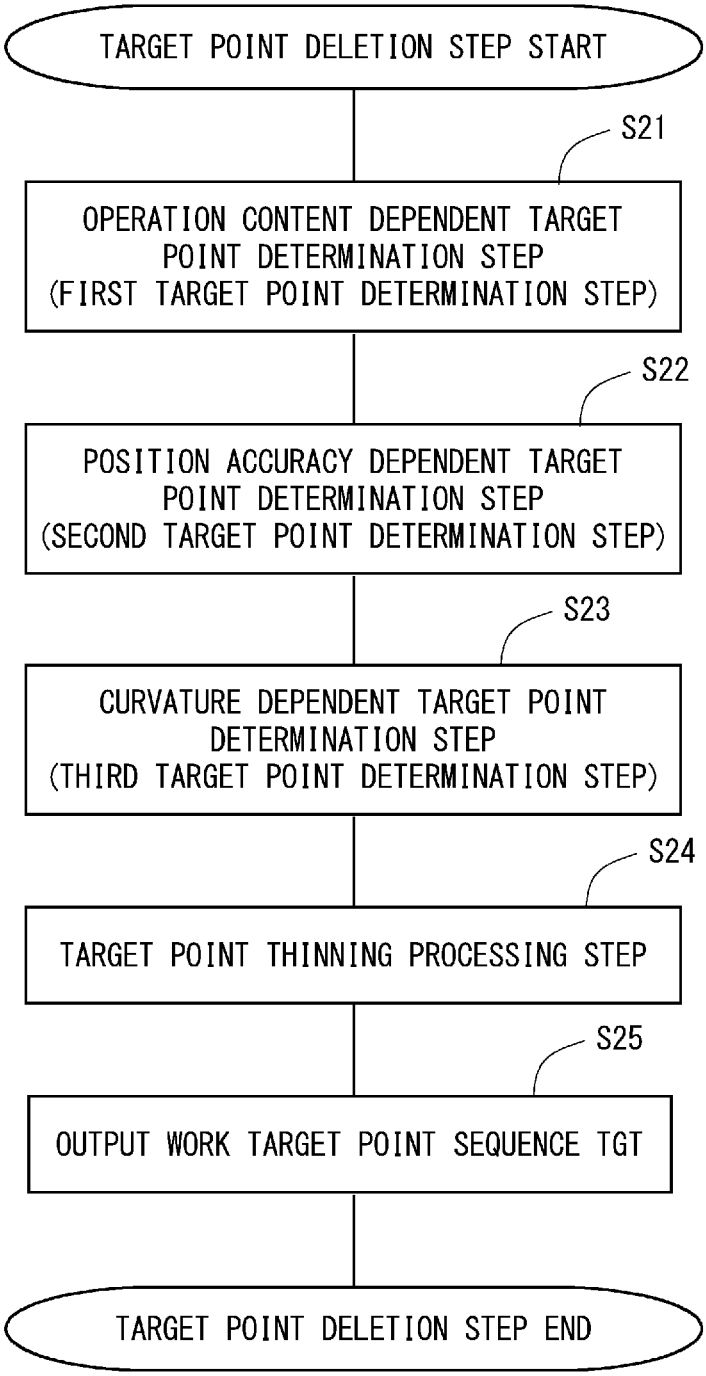
FIG. 8 is a flowchart for describing an operation of a target point deletion processing unit according to the first example embodiment.

As described in the above description of the target point deletion processing unit 32, the target point deletion step includes a plurality of kinds of processing. FIG. 8 shows a flowchart for describing an operation of the target point deletion processing unit 32 according to the first example embodiment.

As shown in FIG. 8, in the target point deletion step, first, the above-described first target point determination step (e.g., operation content dependent target point determination step) is executed by the operation content dependent target point determination processing unit 41 (Step S21). Next, in the target point deletion step, the above-described second target point determination step (e.g., position accuracy dependent target point determination step) is executed by the position accuracy dependent target point determination processing unit 42 (Step S22). Next, in the target point deletion step, the above-described curvature dependent target point determination processing unit 43 executes the above-described third target point determination step (e.g., curvature dependent target point determination step) (Step S23). Next, in the target point deletion step, the above-described target point thinning processing unit 44 executes the above-described target point thinning step (Step S24). After that, in the target point deletion step, the target point thinning processing unit 44 outputs the work target point sequence TGT to the feedback control unit 23 (Step S25).

The processing performed by the aforementioned target point setting unit 30 is performed, for example, by automatic processing using a computation capability of a computer including an arithmetic unit capable of executing a work control program for achieving processing of the initial target point sequence generation unit 31 and the target point deletion processing unit 32 or a target point setting program.

From the above description, the work control system 1 according to the first example embodiment generates a work target point sequence TGT in which the content of the work to be performed by the construction machine 10 indicated by the work content information is taken into account. Accordingly, the work control system 1 according to the first example embodiment is able to perform control in which both the high speed and the high accuracy of the work are achieved regardless of the content of the work to be performed by the construction machine 10.

More specifically, in the work control system 1 according to the first example embodiment, the target point deletion processing unit 32 includes an operation content dependent target point determination processing unit 41 and a position accuracy dependent target point determination processing unit 42. The work control system 1 according to the first example embodiment then performs the aforementioned processing, thereby generating the work target point sequence TGT in which the unevenness of the target points for each unit section in accordance with the content of the work is provided. Accordingly, the work control system 1 according to the first example embodiment is able to control the construction machine 10 by a control with a high accuracy regardless of the content of the work.

Further, the work control system 1 according to the first example embodiment is able to improve the accuracy of control in a section in which it is difficult to make the actual trajectory match the target trajectory by providing the curvature dependent target point determination processing unit 43 in the target point deletion processing unit 32. Further, in the work control system 1 according to the first example embodiment, for a section where a high accuracy of control is not required in view of the shape of the target trajectory, the number of target points may be reduced and the work efficiency can be improved by providing the target point thinning processing unit 44 in the target point deletion processing unit 32.

Further, in the work control system 1 according to the first example embodiment, in the generation of the work target point sequence TGT having unevenness in the target points, the density of the target points is increased only in a part specified as requiring a high positional accuracy in the target trajectory. Therefore, it is possible to reduce the time for generating the work target point sequence TGT without requiring complicated computations. Further, the work control system 1 according to the first example embodiment is highly versatile since there is no need to generate a special control model for each type of the construction machine 10.

While the present invention has been described above with reference to the example embodiment, the present invention is not limited to the example embodiment. Various changes that can be understood by those skilled in the art within the scope of the present invention can be made to the configurations and the details of the present invention.

This application is based upon and claims the benefit of priority from Japanese Patent Application No. 2020-162901, filed on Sep. 29, 2020, the disclosure of which is incorporated herein in its entirety by reference.

REFERENCE SIGNS LIST

1 Work Control System
10 Construction Machine
11 Crawler
12 Turning Base
13 Cockpit
14 Boom
15 Arm
16 Bucket
17 Construction Machine Drive Processing Unit
181-184 Posture Sensor
20 Construction Machine Control Unit
21 Movable Part Control Unit
22 Posture Detection Unit
23 Feedback Control Unit
30 Target Point Setting Unit
31 Initial Target Point Sequence Generation Unit
32 Target Point Deletion Processing Unit
33 Work Content Information Generation Unit
34 Display Unit
41 Operation Content Dependent Target Point Determination Processing Unit
42 Position Accuracy Dependent Target Point Determination Processing Unit
43 Curvature Dependent Target Point Determination Processing Unit
44 Target Point Thinning Processing Unit

The invention claimed is:

1. A work control method comprising:

a target point setting operation comprising generating, based on work content information, a work target point sequence indicating a target trajectory, on which target points a construction machine is to move to, are plotted; and a construction machine control operation comprising controlling generation of a control signal to control the construction machine in accordance with the work target point sequence, wherein the target point setting operation comprises:

an initial target point sequence generation operation comprising generating an initial target point sequence in which intervals of the target points are plotted at predetermined initial intervals and the target points are plotted on the target trajectory; and a target point deletion operation comprising reducing the number of target points included in the initial target point sequence in accordance with the work content information and thus providing unevenness in the density of the target points included in the work target point sequence for each unit section, and wherein the target point deletion operation comprises a first target point determination operation comprising setting more target points as the target points included in the work target point sequence than those left in other sections as the degree of need to make an actual trajectory along which the construction machine actually moves match the target trajectory becomes higher in accordance with the work content information.

2. The work control method according to claim 1, wherein the target point deletion operation includes a second target point determination operation comprising leaving, when the work content information requires a high positional accuracy, more target points which are in the vicinity of a specified position than those left in other sections as the target points included in the work target point sequence.

3. The work control method according to claim 1, wherein the target point deletion operation includes a third target point determination operation comprising setting, for a part where the curvature of the target trajectory is large, more target points to be left as the target points included in the work target point sequence than those left in other sections.

4. The work control method according to claim 1, wherein the target point deletion operation includes a target point thinning operation comprising thinning, when a distance between target points included in the initial target point sequence becomes equal to or larger than a threshold, the target points between which the distance is shorter than the threshold.

5. The work control method according to claim 4, wherein the target point thinning operation excludes the target points set to be left in other processing from the target to be thinned.

6. The work control method according to claim 1, wherein, in the initial target point sequence generation operation, when a curve is provided in a trajectory between the start point and the end point of the target trajectory indicated by the work content information, the shape of the curve is set using a power function, thereby determining the shape of the target trajectory.

7. A work control system comprising:

at least one processor configured to execute:

a target point setting unit configured to generate, based on work content information, a work target point sequence indicating a target trajectory, on which target points a construction machine is to move to, are plotted; and a construction machine controller configured to control generation of a control signal to control the construction machine in accordance with the work target point sequence, wherein the target point setting unit includes:

an initial target point sequence generation unit configured to generate an initial target point sequence in which intervals of the target points are plotted at predetermined initial intervals and the target points are plotted on the target trajectory; and a target point deletion processing unit configured to reduce the number of target points included in the initial target point sequence in accordance with the work content information and thus provide unevenness in the density of the target points included in the work target point sequence for each unit section, and wherein the target point deletion processing unit includes a first target point determination processing unit configured to set more target points as the target points included in the work target point sequence than those left in other sections as the degree of need to make an actual trajectory along which the construction machine actually moves match the target trajectory becomes higher in accordance with the work content information.

8. The work control system according to claim 7, wherein the target point deletion processing unit includes a second target point determination processing unit configured to leave, when the work content information requires a high positional accuracy, more target points which are in the vicinity of a specified position than those left in other sections as the target points included in the work target point sequence.

9. The work control system according to claim 7, wherein the target point deletion processing unit includes a third target point determination processing unit configured to set, for a part where the curvature of the target trajectory is large, more target points to be left as the target points included in the work target point sequence than those left in other sections.

10. The work control system according to claim 7, wherein the target point deletion processing unit includes a target point thinning processing unit configured to thin, when a distance between target points included in the initial target point sequence becomes equal to or larger than a threshold, the target points between which the distance is shorter than the threshold.

11. A target point setting apparatus comprising:

at least one processor configured to execute:

an initial target point sequence generation unit configured to generate an initial target point sequence where target points are plotted at predetermined initial intervals on a target trajectory whose shape is determined based on work content information; and a target point deletion processing unit configured to generate a work target point sequence in which unevenness of the density of the target points is provided for each unit section by reducing the number of target points included in the initial target point sequence in accordance with the work content information, and thus outputting the work target point sequence to a construction machine controller configured to control generation of a control signal to control a construction machine, wherein the target point deletion processing unit includes a first target point determination processing unit configured to refer to the work content information and setting more target points as the target points included in the work target point sequence than those left in other sections as the degree of need to make an actual trajectory along which the construction machine actually moves match the target trajectory becomes higher.

12. The target point setting apparatus according to claim 11, wherein the target point deletion processing unit includes a second target point determination processing unit configured to leave, when the work content information requires a high positional accuracy, more target points which are in the vicinity of a specified position than those left in other sections as the target points included in the work target point sequence.

13. The target point setting apparatus according to claim 11, wherein the target point deletion processing unit includes a third target point determination processing unit configured to set, for a part where the curvature of the target trajectory is large, more target points to be left as the target points included in the work target point sequence than those left in other sections.

14. The target point setting apparatus according to claim 11, wherein the target point deletion processing unit includes a target point thinning processing unit configured to thin, when a distance between target points included in the initial target point sequence becomes equal to or larger than a threshold, the target points between which the distance is shorter than the threshold.

* * * * *